US006830634B2

(12) United States Patent
Herzer et al.

(10) Patent No.: US 6,830,634 B2
(45) Date of Patent: Dec. 14, 2004

(54) METHOD AND DEVICE FOR CONTINUOUS ANNEALING METALLIC RIBBONS WITH IMPROVED PROCESS EFFICIENCY

(75) Inventors: Giselher Herzer, Bruchkoebel (DE); Thomas Hartmann, Altenstadt (DE); Ming-Ren Lian, Boca Raton, FL (US)

(73) Assignees: Sensormatic Electronics Corporation, Boca Raton, FL (US); Vacuumschmelse GmbH, Hanau (DE)

( * ) Notice: Subject to any disclaimer, the term of this patent is extended or adjusted under 35 U.S.C. 154(b) by 180 days.

(21) Appl. No.: 10/167,156

(22) Filed: Jun. 11, 2002

(65) Prior Publication Data

US 2003/0226618 A1 Dec. 11, 2003

(51) Int. Cl.[7] ..... H01F 1/16; C21D 9/54
(52) U.S. Cl. ..... 148/121; 266/103; 432/231
(58) Field of Search ..... 148/120–121; 266/103; 432/231

(56) References Cited

U.S. PATENT DOCUMENTS 4,288,260 A * 9/1981 Senno et al. ..... 148/121
4,444,602 A * 4/1984 Makino et al. ..... 148/121
4,512,824 A * 4/1985 Taub ..... 148/121
5,469,140 A 11/1995 Liu et al.
5,676,767 A 10/1997 Liu et al.
5,684,459 A 11/1997 Liu et al.
5,757,272 A 5/1998 Herzer et al.
5,786,762 A 7/1998 Liu
5,841,348 A 11/1998 Herzer
6,011,475 A 1/2000 Herzer

FOREIGN PATENT DOCUMENTS

WO WO 00/09768 2/2000

OTHER PUBLICATIONS

F. Varret G. Le Gal and M. Henry, Journal of Material Science 24 (1989) p. 3399–3403.

* cited by examiner

*Primary Examiner*—John P Sheehan

(57) ABSTRACT

A thin metallic ferromagnetic alloy ribbon is annealed by continuously transporting it through an oven in order to induce specific magnetic characteristics and in order to remove a production-inherent longitudinal curvature of the ribbon. While the heat-treatment occurs, the ribbon is guided by a channel in a substantially straight annealing fixture. The channel is characterized by slight curvatures along portions of its length, in particular where the ribbon enters into the annealing oven. The curved channel provides an improved thermal contact between the ribbon and the heat reservoir. As a consequence the process can be conducted at particularly high annealing speeds without degrading the desired characteristics.

50 Claims, 6 Drawing Sheets

METHOD AND DEVICE FOR CONTINUOUS ANNEALING METALLIC RIBBONS WITH IMPROVED PROCESS EFFICIENCY

BACKGROUND OF THE INVENTION

This invention relates to a method and device for continuously annealing metallic ribbons. The invention also relates to magnetomechanical markers for electronic article surveillance and a method and an apparatus for making the same.

Amorphous ferromagnetic metals are typically produced by rapid solidification from the melt as a continuous, typically 20–30 $\mu$m thickness ribbon. Due to their atomic structure they exhibit good soft magnetic properties in the as cast state. However, as for any magnetic material, their magnetic properties can be significantly enhanced by a subsequent heat treatment at elevated temperatures (annealing). In this way their properties can be precisely adjusted to the needs of a large variety of applications. Another purpose of the annealing treatment may be to give the ribbon a desired geometrical shape. Typically, when heat-treated at high enough temperatures the metal ribbon takes the geometrical shape it was subjected to during the heat treatment.

Among many applications (for example, in soft magnetic cores), amorphous ferromagnetic metals are widely used as a marker for electronic article surveillance (EAS). Such a marker typically is made of an elongated strip of an amorphous ribbon with well-defined, highly consistent soft magnetic properties. The latter provide the marker with signal identity in order to distinguish it from other objects passing through the interrogation zone of such a surveillance system.

Apart from well-defined magnetic characteristics, many sensor applications, such as markers for EAS, moreover need a substantially flat strip, or a strip with a small well-defined curvature. This is for example necessary to fit the sensor strip into a cavity without bending it. In particular for magnetoelastic sensors, such as acousto-magnetic EAS markers, such bending would result in a severe degradation of the magnetic performance due to magnetostrictive coupling.

One problem with amorphous ribbons is that they reveal a production-inherent longitudinal and/or transverse curvature (c.f. F. Varret, G. Le Gal and M. Henry in Journal of Material Science Vol. 24 (1989) pp. 3399–3402). The height of this curvature may range up to 1000 $\mu$m and more (see below for definition of longitudinal curvature) and originates from thermally induced mechanical stresses during rapid solidification. The height of the curvature is extremely sensitive to the casting conditions, and in practice cannot be controlled in a reliable way. The annealing treatment must therefore also remove this initial curvature of the ribbon and give it a flat shape or a small pre-defined curvature.

A common way of performing the heat treatment is continuous annealing of the metal ribbon. That is the ribbon is fed from a supply reel located on one side of an oven, continuously transported through a zone of elevated temperatures in the oven, and then taken up on a take-up reel on the other side of the oven. In such a process the ribbon is given characteristic properties by careful choice of the annealing parameters such as the temperature profile in the oven and the duration of annealing, which is dependent upon the speed of the ribbon through the oven. A tensile stress, a magnetic field or an electric current applied during annealing can be further used to tailor the magnetic properties.

One way of heating the ribbon is wrapping it around a heated wheel as described in U.S. Pat. No. 5,684,459. In this way an initial longitudinal curvature of the ribbon can be removed within annealing times of a few seconds by bending the ribbon "backwards" against its initial curvature. However, this curvature-removal by counter-bending the ribbon is extremely sensitive to the annealing conditions. The curvature disappears only for a precise annealing time, dependent upon the initial curvature of the ribbon. If, for example, the ribbon is annealed for too long a time, it develops a strong curvature opposite to its original direction. Moreover the curvature reduction affects the magnetic properties. Thus, one has to accept a compromise between curvature reduction and magnetic characteristics.

Another common method is to transport the ribbon in a straight way through an oven such as for example described in U.S. Pat. Nos. 5,757,272, 5,676,767, 5,786,762 and 6,011,475. In this method, the ribbon is guided through the channel of an annealing fixture, which acts as a heat reservoir and which supports the ribbon, such that its straightness during annealing is maintained. Since the ribbon is kept straight, any longitudinal curvature is removed provided the ribbon is exposed to a certain minimum annealing temperature and a certain minimum annealing time. Alternatively, the cross-section of the annealing fixture may have a curved profile in order to give the ribbon a small transverse curl, which enhances the longitudinal bending stiffness and, thus, reduces any longitudinal curvature. The longitudinal curvature-removal process is then largely independent of the precise annealing conditions. Accordingly, the annealing parameters necessary for the magnetic characteristics can thus be optimized independently and without compromise.

However, the major problem of the just mentioned process is associated with the annealing speed. For reasons of process efficiency it is highly desirable to have as high an annealing speed as possible. Yet, in practice, if the annealing speed exceeds a certain limit (for a 2 m long oven typically in the range from 10 to 20 m/min) the desired properties (such as the magnetic characteristics or the flatness) degrade rapidly with increasing speed. Trivially, the annealing speed can always be increased by constructing a correspondingly longer oven. Yet the latter solution significantly increases the cost of the annealing equipment and, thus, again reduces process efficiency.

SUMMARY OF THE INVENTION

According to the state of the prior art for continuous annealing the process efficiency is limited in terms of a maximum annealing speed above which the achievable properties degrade. The inventors have recognized that this problem is not necessarily related to the short annealing times by itself, which are associated with high speeds, but rather is a question of the heat transfer into the ribbon. It is known that a good and quick heat transfer requires direct contact of the metallic ribbon with a heat reservoir, which has a good thermal conductivity. This is for example the case for direct metal-metal contact. Thus, for example, wrapping the ribbon around a heated metallic roller provides an excellent heat transfer into the ribbon and allows high annealing speed. However, the disadvantage is that the ribbon takes the curvature of the heated roller or one has to accept a compromise between this curvature and the magnetic characteristics. Annealing the ribbon in a straight oven resolves this deficiency but only with a significantly reduced annealing speed. The reason is that the heat transfer into the ribbon occurs via the gas atmosphere in the oven, which is a relatively slow process. As a consequence, if the annealing speed becomes too fast, the material does not heat up sufficiently and the achievable properties (such as the magnetic characteristics or the flatness) degrade rapidly with increasing annealing speed. The heat transfer can be improved by guiding the ribbon through a narrow channel of an annealing fixture, which acts as the heat reservoir. However, for a reasonably wide opening, the ribbon tends to move freely through the channel and contacts the walls of the annealing fixture more or less accidentally, which results in a badly defined thermal contact and, thus, in a limited annealing speed.

It is an object of the invention to provide a method and apparatus for annealing a continuous ribbon of material with improved processing efficiency.

It is a further object of the invention to provide a method and apparatus for annealing a ferromagnetic, metallic ribbon in order to achieve characteristic magnetic properties at higher annealing speeds than achievable by conventional methods taught by the prior art without degradation of said properties.

It is another object of the invention to provide a method and apparatus which reduces an initial, e.g. production inherent, curvature of the ferromagnetic metallic ribbon with the proviso that this curvature-reduction is relatively insensitive to the precise annealing conditions (e.g. time and temperature) over a wide range and that it does not degrade other physical properties of the ribbon.

The above objectives can be accomplished by transporting the ribbon lengthwise on a path through a channel in a heat treatment fixture, in which along at least part of the channel protrusions extending transversely of the path cause the ribbon to wriggle and make multiple contacts with the heat treatment fixture, thereby making improved thermal contact with the heat treatment fixture. The objectives can also be accomplished by passing the ribbon lengthwise on a path through a channel in a heat treatment fixture, in which the path curves along a curved section of the channel causing the ribbon to make contact with the heat treatment fixture, thereby making improved thermal contact with the heat treatment fixture.

The protrusions and curved sections may be provided by undulations in the channel walls, which may be up and down curvatures along portions of its length. Along the curved portions of the channel the ribbon is forced into well-defined close contact with the walls of the channel, which significantly improves the heat transfer into the ribbon as compared to straight channels of the prior art. As a consequence the material is heated up much quicker to the temperature of the oven, which allows one to increase the annealing speed and/or build shorter annealing ovens.

Preferably the curved portion of the channel is located at the beginning of the annealing fixture, i.e. where the ribbon enters into the oven. Once sufficient heat has been transferred into the ribbon, the channel can be given a straight form again. The channel then acts as heat reservoir, which holds the ribbon at the annealing temperature.

It may be necessary that the annealing temperature reveals a certain profile, i.e. that the temperature changes along the length of the oven. Accordingly it may be advantageous that the annealing channel reveals curved sections at the locations where the oven temperature changes.

When the ribbon exits the oven it is still hot, which is a problem in particular for high annealing speeds. In another aspect of the invention, the annealing fixture therefore extends beyond the oven and contains a cooled portion, which again reveals a curved section. This guarantees a quick cooling of the ribbon, which may also be critical for the achievable properties.

When the hot ribbon is guided over a curved section, this curvature is annealed into the ribbon at least in part. Thus if the annealing fixture were curved over its whole length, the annealed ribbon would reveal an according curvature. In order to keep the annealed strip flat it is therefore preferable that the annealing fixture is essentially straight and that an "up curvature" is followed by a "down curvature" or vice versa. Similarly the ribbon is also kept straight when a single up or down curvature of the channel is followed by a non-curved portion of at least the same length as the curved portion.

DETAILED DESCRIPTION

Figure 1:
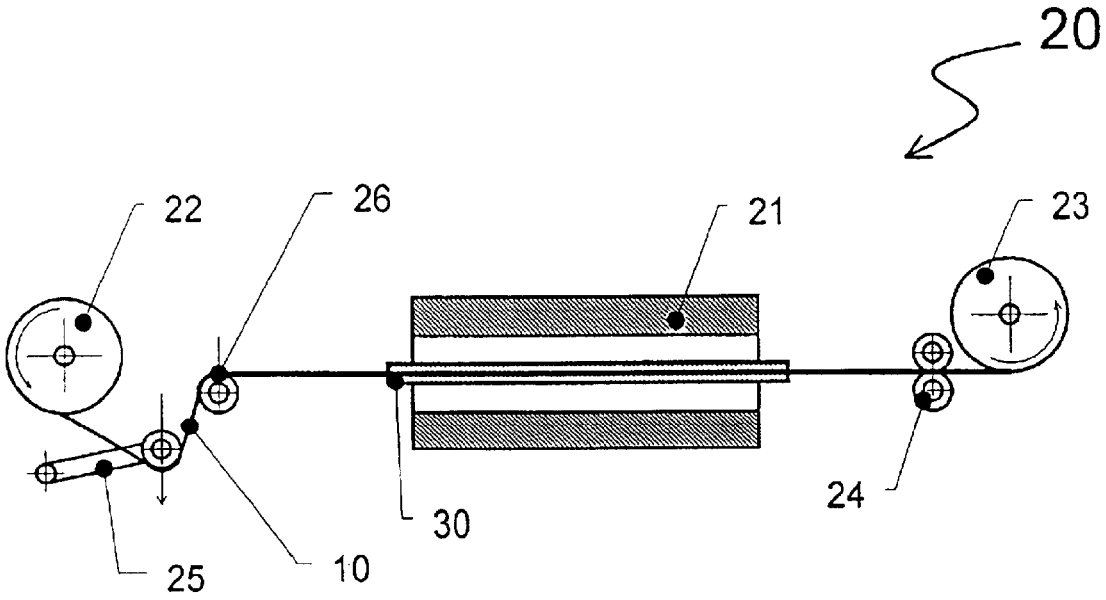
FIG. 1 is a schematic view of the annealing apparatus 20.

FIG. 1 shows a schematic view of the annealing apparatus 20. The annealing apparatus includes an oven 21 and supply and take-up reels 22, 23 at opposite sides of the oven. A continuous ferromagnetic ribbon 10 is unwound from the supply reel 22 and transported through the oven 21 and then taken up on the take-up reel 23. While the ribbon is transported through the oven its path is supported by an essentially straight annealing fixture 30. The ribbon is engaged between a pair of rollers 24, which draw the ribbon 10 through the oven. The roller 26 supports the ribbon such that the ribbon is introduced into the oven in as straight a way as possible.

Numeral 25 indicates a rocker arm and a roller which can be optionally introduced into the path of the ribbon in order to control and modify the tensile force along the ribbon as for example described in the PCT application WO 00/09768. The oven 21 may include means for applying a magnetic field to the ribbon as it is transported through the oven. The magnetic field can be applied perpendicular to the ribbon axis such as for example described in U.S. Pat. Nos. 5,676,767 or 6,011,475 or it can be applied along the ribbon axis such as for example described in U.S. Pat. Nos. 5,757,272 or 5,786,762 or it can be applied in a direction having components both transverse and along the ribbon. Moreover the rollers 26 and 24 may be used to provide an electrical current through the ribbon as for example described in U.S. Pat. No. 5,757,272. The use of any of these modifications depends on the desired magnetic characteristics as, for example, described in detail in the aforementioned applications.

The annealing fixture 30 is described in detail in FIG. 2. As shown in FIG. 2*a* (cross-section) and 2*b* (side view) it consists of an upper part 32 and a lower part 33 and a channel 31 in which the ribbon 10 is transported through the oven. The annealing channel 31 has a width W typically only slightly wider than the ribbon width and a height Z which should be at least several times the ribbon thickness, but preferably at least about a tenth of a millimeter even for very thin ribbons. The latter is related to practical reasons like machining the fixture, ease of introducing the ribbon into the fixture and cleaning the fixture. Typically for a 20–30 $\mu$m thick ribbon, like amorphous metal ribbons, the gap Z in the channel is preferably larger than about 0.2 mm.

Figure 2A:
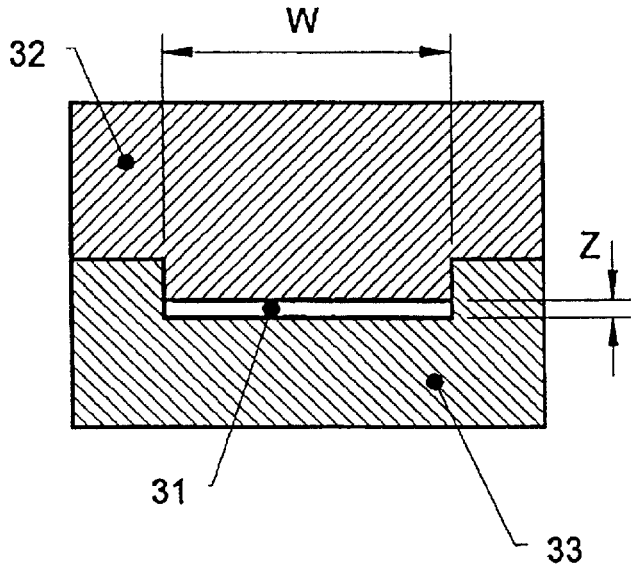
FIG. 2*a* sketches the cross-section, FIG. 2*b* the side view and FIGS. 2*c*, 2*d* the longitudinal sections of the annealing fixture. The annealing fixture according to the principles of this invention is a combination of at least one segment with a curved channel as sketched in FIG. 2*c* followed a straight channel as sketched in FIG. 2*d*.
Figure 2B:
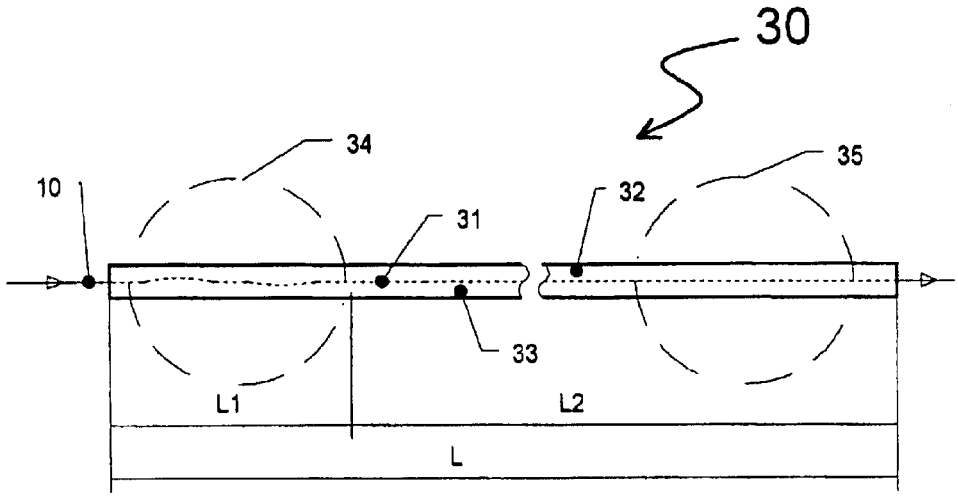
FIG. 2 illustrates the details of the annealing fixture in which the ribbon is transported through the oven.
Figure 2C:
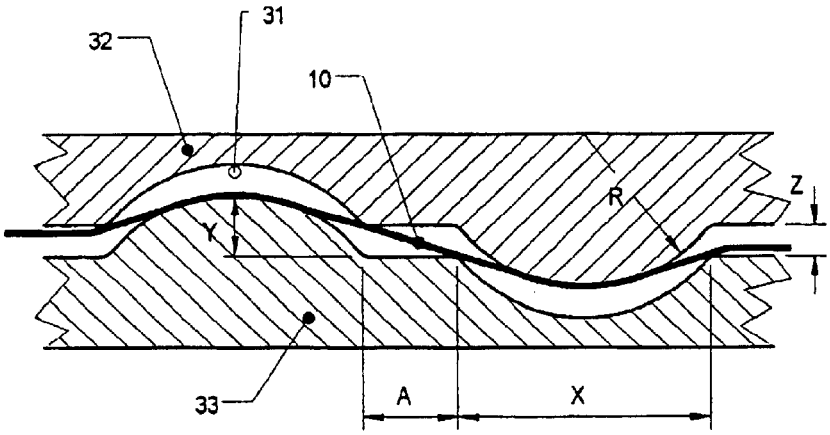
Figure 2D:
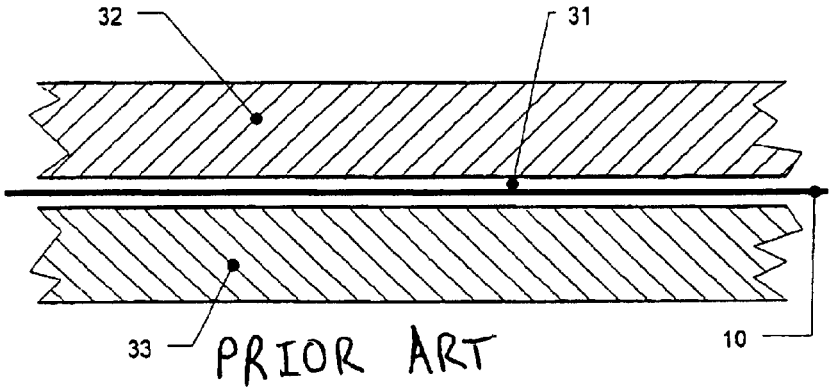

FIGS. 2*c* and 2*d* provide longitudinal sections of the annealing fixture. In annealing fixtures of the prior art the channel 31 through which the ribbon 10 is transported is essentially straight along the whole length L of the fixture as exemplified in FIG. 2*d*. In contrast, the annealing fixture of the present invention reveals certain sections of protrusions in the form of up and down curvatures along its length as schematically indicated in FIG. 2*c*. In particular, it is important that such a curved section of a length L1 is provided at the "beginning" of the fixture, i.e. more precisely in the section 34 (cf. FIG. 2*b*) where the ribbon enters into the zone of elevated temperatures.

The purpose of said curved section is to provide an intimate contact between the ribbon 10 and the hot walls of the upper or lower part 32, 33 of the annealing fixture in order to achieve a good and quick heat transfer into the cold ribbon. In contrast a straight channel as shown in FIG. 2*d* provides only an accidental contact of the ribbon 10 with the hot walls and the heat transfer into the ribbon mainly occurs via the hot oven atmosphere which gives a comparatively slow heating rate. However, once the ribbon is heated up sufficiently to the desired temperature, the contact with the oven atmosphere is sufficient to keep the ribbon at its temperature. Therefore, the channel 31 can be again given a straight form as shown in FIG. 2*d* as soon as the ribbon has reached the targeted temperature.

As a modification, a curved channel may be also used to cool the ribbon down quickly where it exits from the oven, as for example indicated by section 35 in FIG. 2*b*. Similarly if the annealing of the ribbon requires a well-defined temperature profile varying along the path of the oven, curved sections can be introduced at any location where the temperature of the ribbon should change quickly along the annealing path.

The intimate contact of the ribbon with the walls of the annealing fixture in said curved annealing channel might introduce a certain amount of mechanical friction between the ribbon and the wall. It is therefore advantageous to make the up and down curves smooth and to have them only where really needed. The latter is definitely the case at the beginning section 34 of the annealing fixture, where the cold ribbon must be heated to the oven temperature. It should be appreciated that each curvature acts as a protrusion into the channel and as indicated the channel is curved to accommodate the protrusion. As the ribbon passes over such a protrusion or curvature it is flexed first in one way and then in the opposite sense. Such flexing removes any initial curvature of the ribbon.

The example shown in FIG. 2*c* reveals an up and an opposite down curvature. The purpose of this second, opposite curvature is to reduce the risk of a longitudinal curvature being annealed into the ribbon. The same objective can also be achieved if a curvature (up or down) is followed by a straight section of the annealing channel of at least the same length as the curved section. Furthermore, the curvature radius R should preferably exceed about 1 meter in order to keep any potential curvature induced in the ribbon at a minimum level. Obvious modifications of the arrangement shown in FIG. 2 may reveal further up and/or down curvatures and further improve the heat transfer into the ribbon.

FIG. 2*c* gives a detailed view of the curved channel. Each curvature is characterized by a length X and a height Y for the lower part 33 and a height Y+Z for the upper part 32 of the fixture and vice versa if the curvature shows downwards. The curved parts, for example, form the segments of a circle with radius R and R+Z, respectively. The latter is preferable in terms of the ease in machining the fixtures. However, the curved parts may also take different shapes, for example, as defined by a sine wave. The curved sections may be separated by a distance A, for example, for the purpose of ease of mechanical machining and mounting the fixture parts together.

The curvatures shown in FIG. 2*c* are exaggerated for illustration purposes. In reality the curvature is very smooth. The reasons for such a smooth curvature include:

(1) to avoid too much friction between the ribbon;

(2) to keep any potential curvature induced in the ribbon at a minimum level; and/or, (3) to facilitate loading of the annealing fixture with the ribbon.

Therefore the ratio of curvature height Y and curvature length X i.e. Y/X should be chosen much smaller than one, preferably $Y/X<0.05$. Typical dimensions are a curvature length (X) of 100 mm to 500 mm and curvature height (Y) of about 1 mm to 10 mm. Accordingly the curvature radius R preferably lies above about 1 m and may range to several meters. In order to provide the desired contact between the ribbon 10 and the walls of the annealing fixture 32, 33 in the annealing channel 31 the height Y of curvatures is desirably chosen to be larger than the height Z of the annealing channel. Preferably Y/Z is larger than about 2 which means that the ribbon is in close contact with the fixture along about at least 30% of the curvature length X.

A typical material for the annealing fixture is made of steel. For ferromagnetic ribbons "non-magnetic", stainless steel is preferable in particular if magnetic fields are applied during annealing. However alternative materials with reasonable heat conductivity may be used, for example, some ceramics. The latter is necessary if an electric current is flowing through the ribbon during annealing, as for example described in U.S. Pat. No. 5,757,272.

EXAMPLES

Annealing experiments were performed in a 2.5 m long oven heated to 350° C. The oven was surrounded by magnets which produced a magnetic field of about 2500 Oe perpendicular to the axis and to the plane of the heated ribbon as described in full detail in U.S. Pat. No. 6,011,475. Furthermore a tensile stress was applied during annealing. The tensile force was adjusted in a feedback process as described in PCT application WO 00/09768 in order to achieve a pre-determined value of the induced magnetic anisotropy field $H_k$ of about 6 Oe, which determines the basic magnetic characteristics of the material. The material investigated was a 6 mm wide and 20–30 $\mu$m thick amorphous ferromagnetic alloy ribbon having the composition $Fe_{24}Co_{12}Ni_{46.5}Si_{1.5}B_{16}$. The annealed material serves as a marker for electronic article surveillance.

The annealing fixture had a total length of L=3000 mm, a width of 22 mm and a height 18 mm. If not noted otherwise, the annealing channel 31 (cf. FIG. 2*a*) had rectangular cross-section with a width W of 6.2 mm and a height Z of 0.5 mm.

Figure 3:
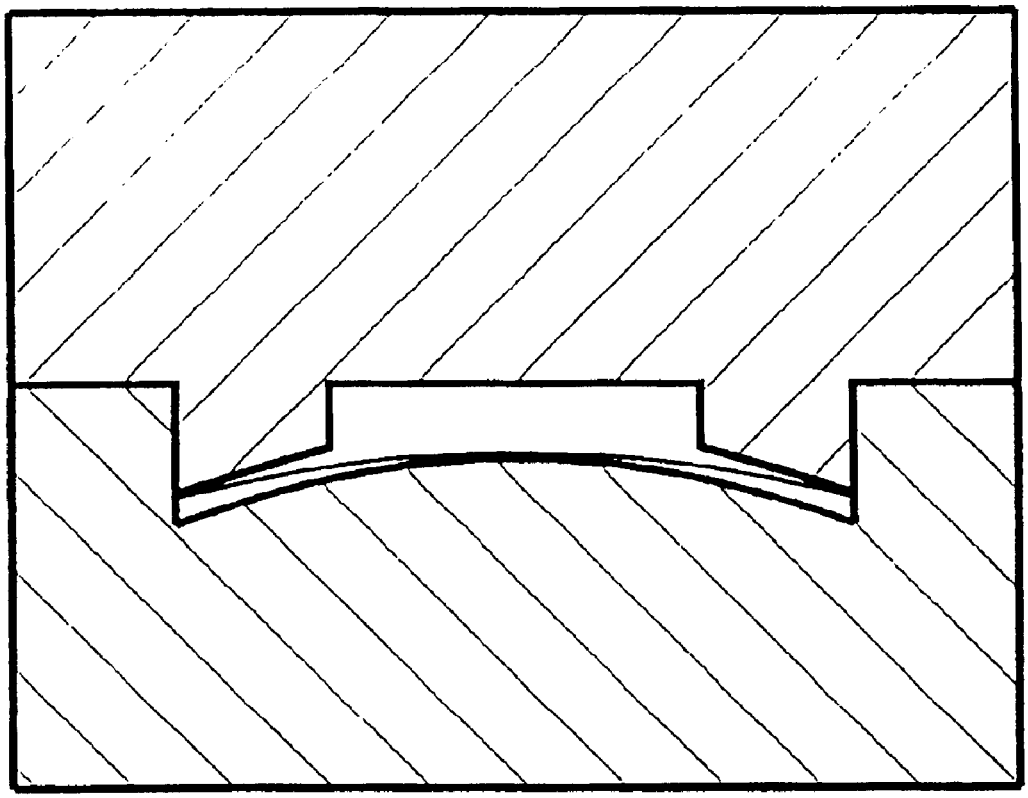
FIG. 3 illustrates an alternative cross-section of the annealing fixture, which gives the annealed ribbon a transverse curvature.

Various configurations of annealing fixtures as listed in table I have been investigated:

1. Comparative fixture C1: In one set of comparative experiments according to the prior art, the annealing channel 31 was straight all along the fixture like shown in FIG. 2*d*.
2. Comparative fixture C2: In another set of comparative experiments according to the prior art the annealing channel again was straight all along the fixture as shown in FIG. 2*d*. However, this time it revealed a curved cross-section as shown in FIG. 3 in order to give the ribbon a transverse curl (cf. U.S. Pat. Nos. 5,676, 767 and 6,011,475). In that case the height Z of the channel was 0.4 mm at the edges and 0.8 mm in the middle of the channel. This transversely curved annealing channel had a length of about 600 mm and was then followed by a 2400 mm long channel according to FIG. 2*d*.
3. Inventive fixtures I1 through I4: For the annealing experiments according to this invention the annealing fixture was modified to reveal curved sections as sketched in FIG. 2*c* at its beginning (i.e. where the ribbon comes into the heated zone) along a length L1. This curved section was followed by a straight channel along a length L2=L−L1 (cf. FIG. 2*b*). The curved segments were arranged as indicated for examples I1 through I4 in table I. Each of the curved segments started with a straight segment of 50 mm length (=A/2), followed by a segment of a circle of 200 mm length (=X), followed again by a straight segment of 50 mm again. The total length of such a curved segment being thus 300 mm. The curvature radius of R was 1500 mm and the height Y of the circle segment was 3.34 mm.

Each of the described configurations C1, C2 and I1 through I4 was tested with annealing speeds ranging from 15 m/min to 44 m/min. The upper limit of 44 m/min results from the fact that the motors of the present annealing equipment did not allow for higher speeds. The maximum speed of 44 m/min, therefore, does not represent a limitation regarding this invention. These speeds correspond to times within the annealing fixture of 12 seconds (15 m/min) and 4.1 seconds (44 m/min). Other speeds correspond to times within the annealing fixture as follows: 20 m/min (9 seconds); 30 m/min (6 seconds); 40 m/min (4.5 seconds);

Table I

Cross sections and longitudinal sections of the annealing channel for the investigated configurations of the annealing fixture. C1 and C2 are comparative examples. I1 through I4 are configurations according to the present invention. As for the cross-section "rectangular" denotes a cross-section according to FIG. 2*a* and "curved" a cross-section according to FIG. 3. As for the longitudinal section, U denotes a segment with upward curvature according to the left half of FIG. 2*c*, D a segment with downward curvature according to the right half of FIG. 2*c*) and "straight" a straight channel according to FIG. 2*d*.

TABLE I

Cross sections and longitudunal sections of the annealing channel for the investigated configurations of the annealing fixture. C1 and C2 are comparative examples. I1 through I4 are configurations according to the present invention. As for the cross-section "rectangular" denotes a cross-section according to FIG. 2a and "curved" a cross-section according to FIG. 3. As for the longitudinal section, U denotes a segment with upward curvature according to the left half of FIG. 2c, D a segment with downward curvature according to the right half of FIG. 2c) and "straight" a straight channel according to FIG. 2d.

| Fixture | Cross Section | Longitudinal Section |
|---|---|---|
| C1 | rectangular | Straight (comparative example) |
| C2 | curved | Straight (comparative example) |
| I1 | rectangular | U + straight |
| I2 | rectangular | U + D + straight |
| I3 | rectangular | U + D + U + straight |
| I4 | rectangular | U + D + U + D + straight |

TABLE 2

Curl, non-linearity of the BH-loop and resonant amplitude A1 of the as cast material and after annealing at 350° C. with an annealing speed of 40 m/min in the fixture configurations C1 and C2 (=comparative examples) and I1 through I4 according to table I

| Sample | Curl ($\mu$m) | Non-Linearity of BH-loop | A1 (mV) |
|---|---|---|---|
| as cast | 320 | 95% | 15 |
| C1 | 435 | 8.0% | 125 |
| C2 | 152 | 1.6% | 126 |
| I1 | 27 | 1.0% | 155 |
| I2 | 24 | 0.6% | 166 |
| I3 | 24 | 0.7% | 163 |
| I4 | 14 | 0.5% | 167 |

Figure 4:
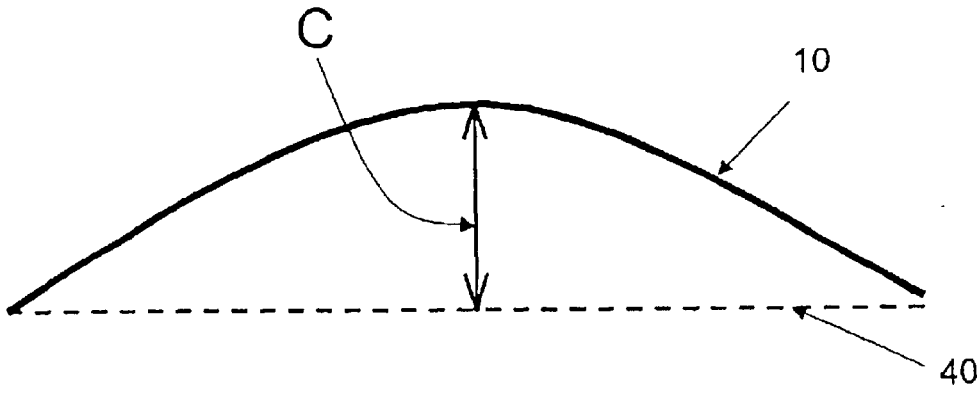
FIG. 4 illustrates the definition of the curl C of a piece of ribbon. The curvature may be in transverse and/or longitudinal ribbon direction. The curl is defined as the maximum height C between the ribbon 10 and a flat surface 40 on which a strip of a certain length and a certain width is put. For the longitudinal curvature, in this specification, the curl is the maximum height C between a ribbon 10 of a 38 mm long piece of a 6 mm wide ribbon and the flat surface 40.
Figure 7:
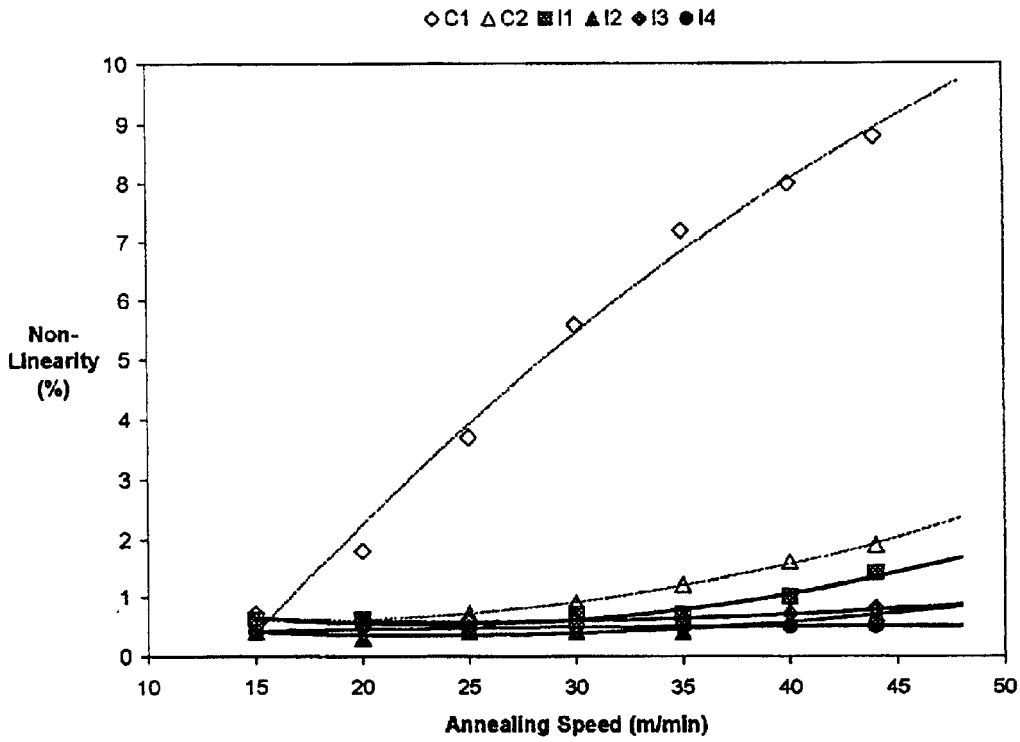
FIG. 7 shows the non-linearity of the BH-loops of a 6 mm wide ribbon annealed at 350° C. as a function of the annealing speed. C1 and C2 denote comparative examples of the prior art; I1 through I4 denote samples annealed according to the teaching of this invention.
Figure 8:
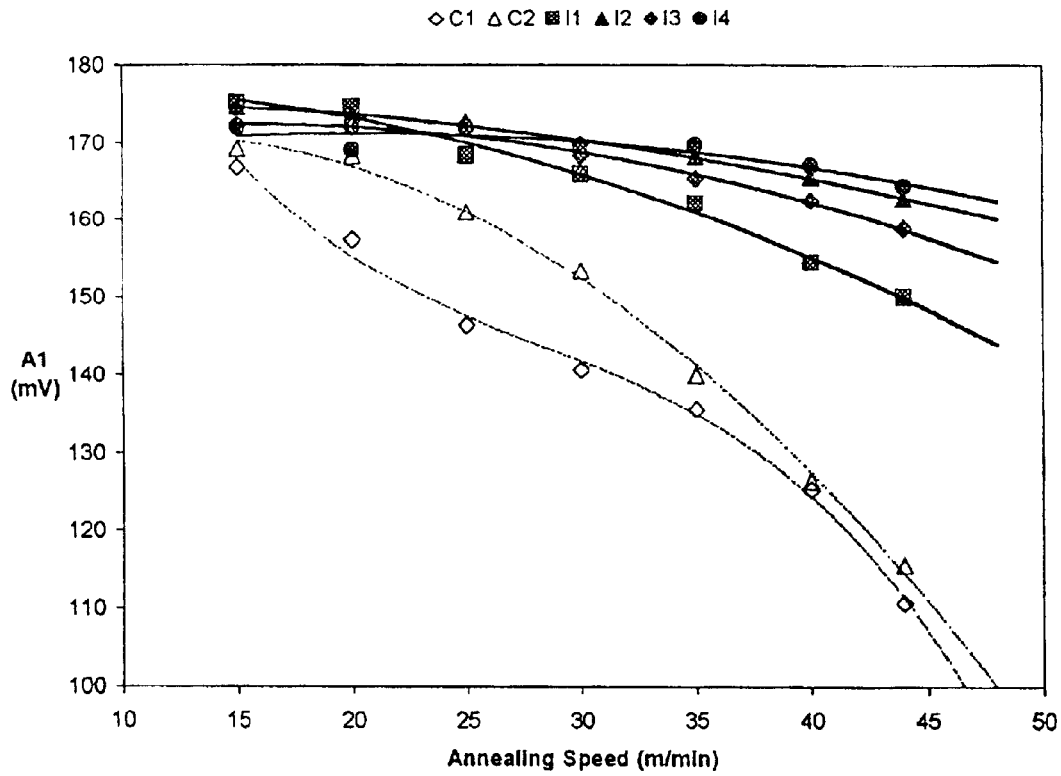
FIG. 8 shows the resonant signal A1 of a 38 mm long piece of a 6 mm wide ribbon annealed at 350° C. as a function of the annealing speed. C1 and C2 denote comparative examples of the prior art; I1 through I4 denote samples annealed according to the teaching of this invention.

The properties tested after annealing were the curl of the ribbon (cf. FIGS. 4 and 5), the non-linearity of the BH-loop (cf. FIGS. 6 and 7) and the resonant amplitude (cf. FIG. 8). Some of the results are also summarized in Table II.

Generally, the tested annealing configurations essentially yield the same result for the lowest annealing speed of 15 m/min. However, the properties of the comparative examples C1 and C2 degraded significantly with increasing annealing speed in terms of a higher longitudinal curl, a higher non-linearity and lower resonant amplitude, while the inventive examples I1 through I4 showed up only a minor degradation, if at all. The only exception is the curl for the comparative configuration C2 in which the material is purposely given a small transverse curl. The results are now discussed in more detail in the following.

The curl C as defined here is the maximum height C between the ribbon 10 and a flat, metallic surface 40 on which a strip of 38 mm length and 6 mm width was put. (cf. FIG. 4). The curl was measured with a capacitance micrometer, which is capable to resolve the curl with an accuracy of about 20 $\mu$m. Typically the curl of the cast material ranges from about 200–1200 $\mu$m. If annealed in an essentially straight path, a low curl is characteristic of a successful anneal treatment.

Figure 5:
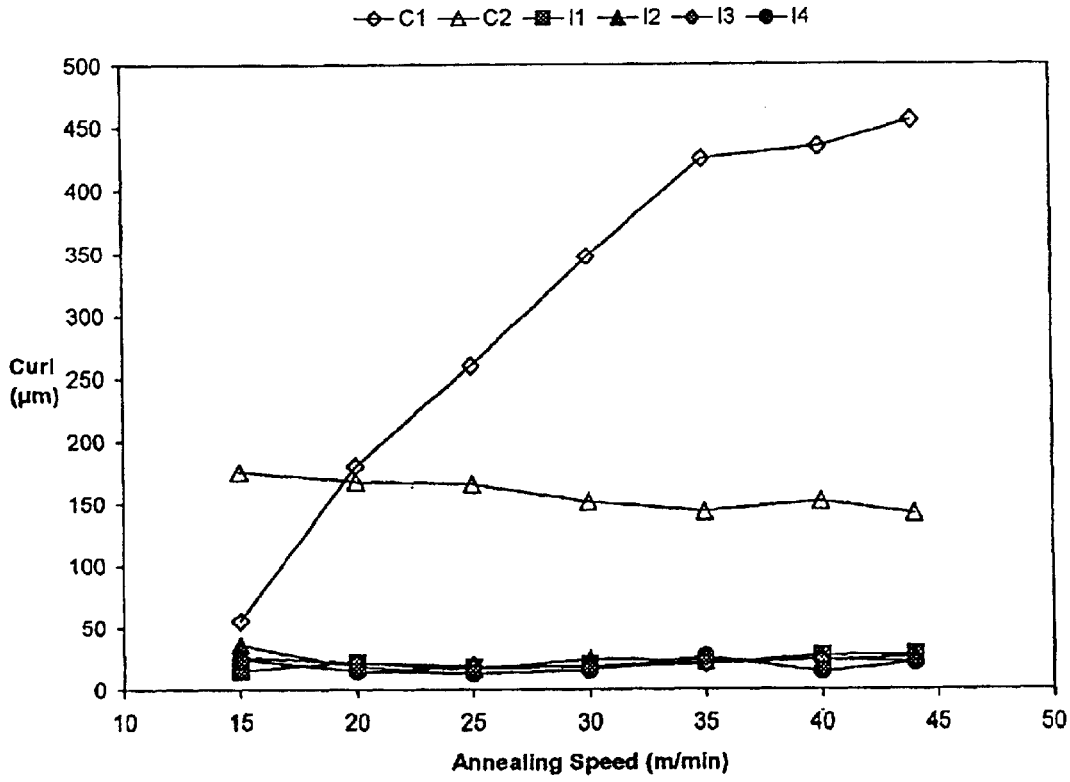
FIG. 5 shows the curl of a 38 mm long piece of a 6 mm wide ribbon annealed at 350° C. as a function of the annealing speed. C1 and C2 denote comparative examples of the prior art; I1 through I4 denote samples annealed according to the teaching of this invention.

The results for the curl are given in FIG. 5. The comparative fixture C1 produces a very pronounced increase of the curl with increasing annealing speed. The pre-dominant curvature was in longitudinal direction. The reason is that the initial, curl of the ribbon is not removed sufficiently at higher annealing speeds due to the relatively bad thermal contact. At high annealing speeds the curl even exceeded its initially measured value of 320 $\mu$m that is supposed to reflect the relatively large scatter of the as cast curl. For the comparative annealing fixture C2 the curl shows a minor variation with the annealing speed ranging between about 150 $\mu$m and 200 $\mu$m. This mainly reflects the transverse curl which was purposely induced as described further above. This transverse curl enhances the bending stiffness of the ribbon, which suppresses longitudinal curling. The material annealed with the inventive annealing fixtures I1 through I4 shows the lowest curl and, thus, is substantially flat irrespective of the annealing speed. The low curl values are of the order of the measuring accuracy of the curl measurements. The actual curvature thus may be even lower. Accordingly, the fixtures I1 through I4 have a clear benefit over the comparative fixtures C1 and C2 in terms of achieving low curvature of the annealed ribbons for a given ribbon speed.

In a further series of experiments, material with an as cast curl as large as 1200 $\mu$m was chosen. When annealed in fixtures I1 through I4, the material again revealed the same low curl as shown in FIG. 5.

Figure 6:
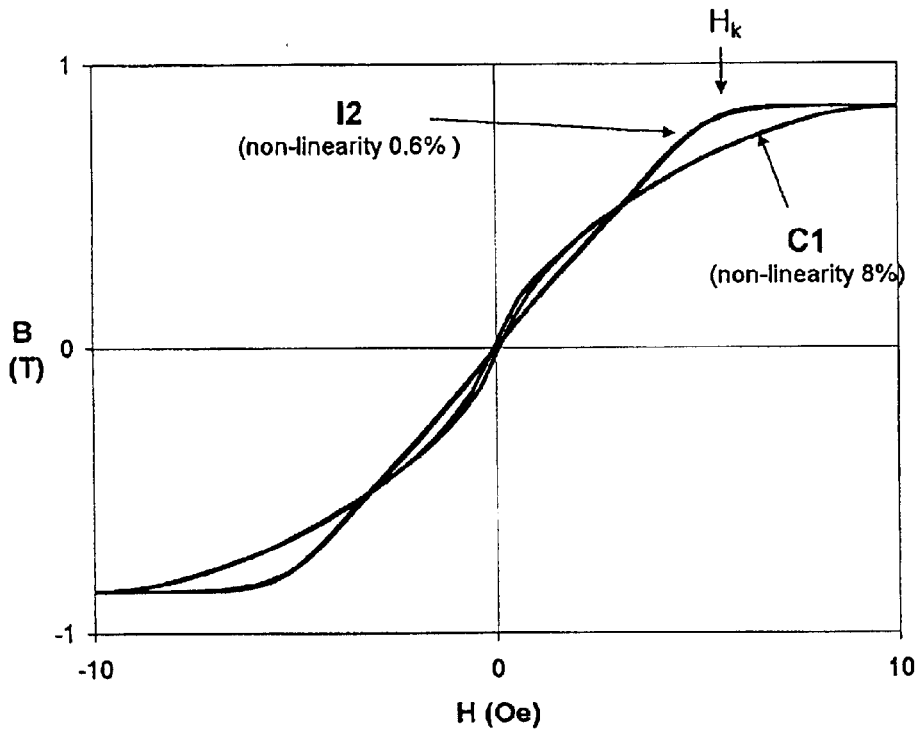
FIG. 6 shows the BH-loops measured for a 6 mm wide ribbon, field annealed with an annealing speed of 40 m/min. C1 (non-linear loop) denotes a comparative examples of the prior art and I2 (linear loop) is an example annealed according to the teaching of this invention. The figure also provides the definition of the anisotropy field $H_k$ that is the magnetic field strength where the magnetization turns into saturation.

The non-linearity NL of the BH-loop after annealing is defined as the mean square root deviation of the BH-loop (measured on a 10 cm long ribbon) with respect to a linear fit of the BH-loop. That is more precisely $$NL(\text{in }\%) = \frac{100}{B_{\max}}\sqrt{\frac{1}{N}\sum_{i=1}^{N}(B_{meas}(H_i) - B_{Fit}(H_i))^2},$$

where $B_{meas}(H_i)$ is the measured and $B_{Fit}(H_i)$ is the fitted induction at a field strength $H_i$ where $B/B_{max}<0.75$. Generally annealing a ferromagnetic, amorphous ribbon in a magnetic field perpendicular to the ribbon axis is supposed to give a BH-loop which is essentially linear as a function of the magnetic field until it is saturated ferromagnetically when the applied magnetic field exceeds the anisotropy field $H_k$. A low degree of non-linearity, i.e. typically less than about 1% is a characteristic feature if the annealing was fully successful. FIG. 6 gives an example for a linear and less linear loop. A linear BH-loop, for example, is crucial for acousto-magnetic markers in order to avoid false alarms in harmonic systems (cf. U.S. Pat. Nos. 5,469,140 and 6,011,475).

FIG. 7 shows the results for the non-linearity of the BH-loop. The comparative fixture C1 produces a large degradation of the magnetic properties with increasing annealing speed in terms of significantly non-linear BH loops. The reason for this non-linearity is two-fold. First, production-inherent mechanical stress is not relieved sufficiently at high annealing speeds. Second, additional mechanical stresses arise when the longitudinally curved ribbon is put in a straight way into the BH-loop tracer. The latter reflects also the degradation mechanism, which occurs when a short piece of the curved strip is deformed when put into a housing of insufficient height H (cf. FIG. 9). Said mechanical stresses produce via magnetostrictive interactions a distribution of magnetic easy axis, which results in the observed non-linearity. The degradation is less pronounced with comparative fixture C2. This is interpreted in terms of the better thermal contact due the circumstance that the ribbon touches the annealing fixture at least in part when it is bent transversely. Additionally the transversely induced curvature keeps the ribbon straight along its longitudinal axis such that no additional bending arises during the BH-loop measurement or when the ribbon is put into the label. Yet, for the ribbons annealed according to this invention (examples I1 through I4), the non-linearity at high annealing speed is still significantly lower. In particular the configurations I2 through I4 give extremely linear loops with a non-linearity well below about 1% even at high annealing speeds.

The magnetoelastic resonant amplitude A1 of a 38 mm long strip is the induced voltage in a sense coil having 100 turns about 1 ms after exciting resonant vibrations by a tone burst of an magnetic ac-field (maximum amplitude 17.8 mOe—frequency about 58 kHz—1.6 ms pulses with a pulse frequency of 50 Hz). The resonant amplitude A1 is a specific characteristic of the magnetoelastic response of a ferromagnetic, magnetostrictive alloy. High amplitude is a very sensitive probe for the success of the annealing treatment. In the present example the resonant amplitude was measured at a dc-bias field of 6.5 Oe, which approximately corresponds to the bias field where A1 reveals its maximum value as a function of the bias field.

FIG. 8 shows the results for the resonator signal, which best resolves the differences between the various fixture configurations. Both comparative fixtures of the prior art show a severe degradation of the amplitude with increasing annealing speed. In comparison the amplitude for the material annealed in the inventive fixture configurations I1 through I4 retains more than 80% of the "slow speed" amplitude even at the highest investigated annealing speeds.

In a series of further experiments the height Z of the annealing channel was increased from 0.5 mm to 0.8 mm. Despite of this relatively wide opening, no degradation could be found for the material annealed according to this invention.

Figure 9:
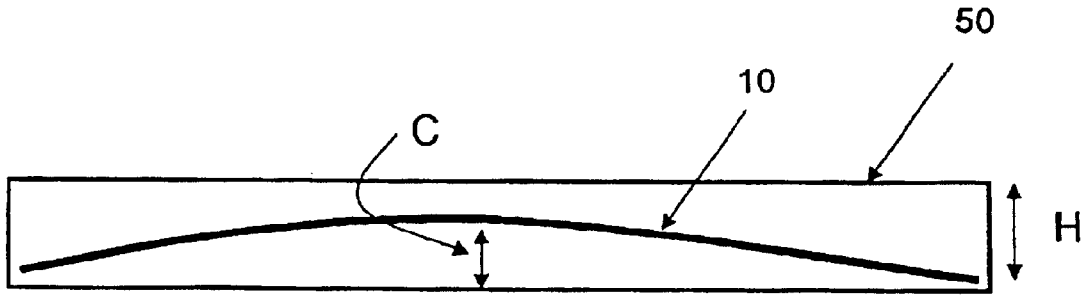
FIG. 9 is a sketch of an acousto-magnetic marker, which consists of an elongated strip of an amorphous ribbon 10 and a housing 50.

In one preferred embodiment the described annealing method is used to provide resonators for acousto-magnetic markers for electronic article surveillance as for example described U.S. Pat. Nos. 5,469,140 or 5,841,348. In such a marker the resonator strip 10 is embedded into housing 50 as schematically shown in FIG. 9. It is essential that the resonator may vibrate freely within the cavity to achieve good performance in the surveillance system. Any mechanical interference of the resonator with its housing will cause a drastic reduction in its performance. Therefore it is necessary to maintain a clearance H in the resonator cavity which must be larger than the curl C of the resonator so that the resonator can resonate non-obstructively. Typical markers on the market use resonator material annealed according to comparative method C2 which exhibits a slight transverse curl C of about 200 $\mu$m. The total height H of the cavity typical is about 600 $\mu$m. On the other hand a thinner marker with lower height H is more conveniently attached to merchandise. In order to provide such a thinner marker, the resonator must therefore be made as flat as possible to avoid any performance degradation. This can be advantageously realized with a flat resonator annealed according to the principles of this invention.

The embodiment of the invention described so far provides a flat ribbon with good magnetic characteristics at high annealing speeds. However the process is also capable of providing a ribbon with transverse curvature and good magnetic characteristics at higher annealing speeds than achievable with methods according to the prior art. Thus, the annealing fixture may consists of a longitudinally curved section which serves to enhance the annealing speed according to the principals of this invention, then followed by a straight section with a transversely curved cross-section in order to give the ribbon a small transverse curl.

Various other changes in the foregoing described practices may be introduced without departing from this invention. The particularly preferred embodiments of the invention are thus intended in an illustrative and not limiting sense. The true spirit and scope of the invention is set in the following claims.

What is claimed is:

1. A method of annealing a thin metallic ribbon by passing the ribbon lengthwise on a path through a channel in a heat treatment fixture, in which along at least part of the channel protrusions extending transversely of the path cause the ribbon to wriggle and make multiple contacts with the heat treatment fixture, thereby making improved thermal contact with the heat treatment fixture.

2. A method as claimed in claim 1, in which the protrusions are present at a location close to the beginning of a heated zone in the heat treatment fixture.

3. A method as claimed in claim 1, in which the heat treatment fixture has regions of different temperature, and protrusions are present at a location close to the beginning of such a region in the heat treatment fixture.

4. A method as claimed in claim 1, in which the heat treatment fixture has a cooling section and protrusions are present at a location in the cooling section, thereby improving cooling of the ribbon.

5. A method as claimed in claim 1, in which the heat treatment fixture is substantially straight.

6. A method as claimed in claim 1, in which the protrusions are formed as undulations in walls of the channel.

7. A method as claimed in claim 6, in which the undulations are formed as a curved section in the channel.

8. A method as claimed in claim 7, in which the curved section has a radius of curvature of at least 1000 mm.

9. A method as claimed in claim 1, in which a given portion of the ribbon passes through the heat treatment fixture in 9 seconds or less.

10. A method as claimed in claim 9, in which a given portion of the ribbon passes through the heat treatment fixture in 6 seconds or less.

11. A method as claimed in claim 10, in which a given portion of the ribbon passes through the heat treatment fixture in 4.5 seconds or less.

12. A method as claimed in claim 1, in which the ribbon is transported through the heat treatment fixture at 20 m/min or more.

13. A method as claimed in claim 12, in which the ribbon is transported through the heat treatment fixture at 30 m/min or more.

14. A method as claimed in claim 13, in which the ribbon is transported through the heat treatment fixture at 40 m/min or more.

15. A method as claimed in claim 1, in which the annealing includes exposure to a temperature in the range 200° C. to 500° C.

16. A method as claimed in claim 15, in which the annealing includes exposure to a temperature in the range 300° C. to 400°.

17. A method as claimed in claim 1, in which the channel has a height and the protrusion has a height larger than the channel height, the channel being curved to accommodate the protrusion.

18. A method as claimed in claim 1, in which the ribbon is a ferromagnetic, amorphous alloy ribbon.

19. A method as claimed in claim 1, for producing a magnetoelastic marker for electronic article surveillance.

20. A method as claimed in claim 1, in which protrusions from one side of the path cause the ribbon to wriggle in a first direction, and protrusions from another side of the path cause the ribbon to wriggle in a second direction.

21. A method as claimed in claim 20, in which the first and second directions are opposed directions.

22. A method of annealing a thin metallic ribbon by passing the ribbon lengthwise on a path through a lengthwise channel in a heat treatment fixture, in which the path curves along a curved section of the channel urging the ribbon into contact with the heat treatment fixture, thereby making improved thermal contact with the heat treatment fixture.

23. A method as claimed in claim 22, in which the path curves in one direction, followed by a curve in an opposed direction.

24. A method as claimed in claim 22, in which the curved section is followed by a straight channel.

25. A method as claimed in claim 24, in which the curved section is followed by a straight channel of at least the same length.

26. A method as claimed in claim 22, in which the curved section has a curvature with a height Y which is larger than the height Z of the annealing channel.

27. A method as claimed in claim 22, in which the curved section has a curvature having a height Y and a length X, the ratio Y/X of the height to the length being much smaller than 1.

28. A method as claimed in claim 22, in which the opening height of the channel is at least 0.2 mm (preferably at least 0.5 mm).

29. A method as claimed in claim 22, for producing a magnetoelastic marker for electronic article surveillance.

30. A heat treatment fixture for apparatus for annealing a thin metallic ribbon, comprising:

a) a lengthwise channel defining a path to receive ribbon lengthwise;

b) protrusions extending transversely of the path such that the path is curved lengthwise along at least part of its length.

31. A heat treatment fixture as claimed in claim 30, in which the channel has a height and the protrusion has a height larger than the channel height, the channel being curved to accommodate the protrusion.

32. A heat treatment fixture as claimed in claim 30, in which the protrusions are defined by undulations in walls of the channel.

33. A heat treatment fixture for apparatus for annealing a thin metallic ribbon, comprising a lengthwise channel defining a path to receive ribbon lengthwise, the channel comprising at least one curved section in the channel such that the path is curved along at least part of its length.

34. A heat treatment fixture as claimed in claim 33, in which the curved section has a radius of curvature of at least 1000 mm.

35. A heat treatment fixture as claimed in claim 30, in which the heat treatment fixture has protrusions present at more than one location separated by straight regions in the channel, defining separate sections of the heat treatment fixture.

36. Apparatus for annealing a thin metallic ribbon, comprising a heat treatment fixture as claimed in claim 33, a supply reel to supply ribbon, and a take-up reel to take up annealed ribbon.

37. Apparatus as claimed in claim 36, comprising means to drive the ribbon from the supply reel, through the heat treatment fixture, and onto the take-up reel at speeds in excess of 20 m/min.

38. Apparatus for annealing a thin metallic ribbon, comprising a heat treatment fixture as claimed in claim 33, a supply reel to supply ribbon, and a take-up reel to take up annealed ribbon.

39. Apparatus as claimed in claim 38, comprising means to drive the ribbon from the supply reel, through the heat treatment fixture, and onto the take-up reel at speeds in excess of 20 m/min.

40. A method of annealing a thin metallic ribbon by passing the ribbon lengthwise on a path through a channel in a heat treatment fixture, in which the path curves in one direction, followed by a curve in an opposed direction along at least a portion of the channel, urging the ribbon into contact with the heat treatment fixture, thereby making improved thermal contact with the heat treatment fixture.

41. A method as claimed in claim 40, in which the curved section has a curvature with a height Y which is larger than the height Z of the annealing channel.

42. A method as claimed in claim 40, in which the curved section has a curvature having a height Y and a length X, the ratio Y/X of the height to the length being much smaller than 1.

43. A method as claimed in claim 40, in which the opening height of the channel is at least 0.2 mm (preferably at least 0.5 mm).

44. A heat treatment fixture for apparatus for annealing a thin metallic ribbon, comprising:

a) a channel defining a path to receive ribbon lengthwise; and b) protrusions extending transversely of the path such that the path is curved along at least part of its length; and wherein the channel has a height and the protrusion has a height larger than the channel height, the channel being curved to accommodate the protrusion.

45. A heat treatment fixture as claimed in claim 44, in which the protrusions are defined by undulations in walls of the channel.

46. A heat treatment fixture for apparatus for annealing a thin metallic ribbon, comprising a channel defining a path to receive ribbon lengthwise, the channel comprising at least one curved section in the channel such that the path is curved along at least part of its length; and wherein the curved section has a radius of curvature of at least 1000 mm.

47. A heat treatment fixture as claimed in claim 46, in which the heat treatment fixture has protrusions present at more than one location separated by straight regions in the channel, defining separate sections of the heat treatment fixture.

48. Apparatus for annealing a thin metallic ribbon, comprising a heat treatment fixture as claimed in claim 46, a supply reel to supply ribbon, and a take-up reel to take up annealed ribbon and comprising means to drive the ribbon from the supply reel, through the heal treatment fixture, and onto the take-up reel at speeds in excess of 20 m/min.

49. Apparatus for annealing a thin metallic ribbon, comprising a heat treatment fixture as claimed in claim 46, a supply reel to supply ribbon, and a take-up reel to take up annealed ribbon.

50. Apparatus as claimed in claim 49, comprising means to drive the ribbon from the supply reel, through the heat treatment fixture, and onto the take-up reel at speeds in excess of 20 m/min.

* * * * *